US007334543B2

(12) United States Patent
Pawellek

(10) Patent No.: US 7,334,543 B2
(45) Date of Patent: Feb. 26, 2008

(54) COOLANT PUMP, ESPECIALLY ELECTRIC CONVECTION-COOLED COOLANT PUMP WITH INTEGRATED DIRECTIONAL CONTROL VALVE, AND CORRESPONDING METHOD

(75) Inventor: Franz Pawellek, Lautertal (DE)

(73) Assignee: Geraete-und Pumpenbau GmbH Dr. Eugen Schmidt, Merbelsrod (Thuer.) (DE)

( * ) Notice: Subject to any disclaimer, the term of this patent is extended or adjusted under 35 U.S.C. 154(b) by 211 days.

(21) Appl. No.: 10/551,467

(22) PCT Filed: Mar. 10, 2004

(86) PCT No.: PCT/EP2004/002455

§ 371 (c)(1),
(2), (4) Date: Sep. 30, 2005

(87) PCT Pub. No.: WO2004/088143

PCT Pub. Date: Oct. 14, 2004

(65) Prior Publication Data

US 2006/0216166 A1 Sep. 28, 2006

(30) Foreign Application Priority Data

Mar. 31, 2003 (DE) ..... 103 14 526

(51) Int. Cl.
*F01P 7/14* (2006.01)
*F01P 5/10* (2006.01)
*F04B 17/00* (2006.01)

(52) U.S. Cl. ..... 123/41.1; 123/41.44; 417/366; 417/410.1

(58) Field of Classification Search ..... 123/41.08, 123/41.09, 41.1, 41.44; 417/366, 410.1
See application file for complete search history.

(56) References Cited

U.S. PATENT DOCUMENTS 5,415,134 A 5/1995 Stewart, Jr.

FOREIGN PATENT DOCUMENTS

DE 37 39 494 A1 6/1989

(Continued)

*Primary Examiner*—Noah P. Kamen
(74) *Attorney, Agent, or Firm*—The Nath Law Group; Jerald L. Meyer; Jonathan A. Kidney

(57) ABSTRACT

A coolant pump and method thereof for a coolant circuit of the internal combustion engine of a motor vehicle including at least a radiator circuit and a bypass circuit is disclosed. The coolant pump contains a coolant pump housing (14) which is provided with an intake pipe (22), a bypass pipe (24), and a pressure pipe (34). A coolant pump electric motor (26) is arranged in the coolant pump housing (14), the motor housing (28) of which is situated in the coolant flow, drives a pump impeller (32) via a pump shaft (30). A directional control valve (40) is integrated into the coolant pump housing (14). The intake pipe (22) is arranged in the area of the end of the pump motor facing away from the pump impeller (32). Furthermore the bypass pipe is arranged in an area downstream of the intake pipe (22).The pressure pipe (34) is arranged in an area downstream of the bypass pipe (24). Only the coolant that can be taken in by the radiator via the intake pipe is adapted to be guided past the pump motor in a peripheral flow (50) in particular through a flow channel (56) limited by the outer wall (52) of the pump motor housing (28) and the facing inner wall (54) of the pump housing and/or the facing inner wall (60) of the directional control valve (40).

27 Claims, 11 Drawing Sheets

FOREIGN PATENT DOCUMENTS

| | | | |
|---|---|---|---|
| DE | 38 17 952 | A1 | 11/1989 |
| DE | 198 09 123 | A1 | 9/1999 |
| DE | 199 43 981 | A1 | 3/2001 |
| DE | 100 47 387 | A1 | 4/2002 |
| FR | 2 667 020 | A3 | 3/1992 |
| JP | 2002-130190 | | 5/2002 |

COOLANT PUMP, ESPECIALLY ELECTRIC CONVECTION-COOLED COOLANT PUMP WITH INTEGRATED DIRECTIONAL CONTROL VALVE, AND CORRESPONDING METHOD

The present invention concerns a coolant pump for a coolant circuit of an automotive internal combustion engine and a method for conveying coolant thereto.

Recent investigations into the fuel consumption of automotive internal combustion engines show that a consistently performed thermal management in a current-day automotive internal combustion engine may provide fuel savings of about 3 to 5%. Thermal management here refers to those measures that result in an energetically and thermo-mechanically optimum operation of an internal combustion engine. To this end an active control of the heat flows and thus of the temperature distribution inside the engine is necessary.

An accurate feedback control of the coolant throughput and of the temperature of the circulated coolant thus also becomes necessary. Accordingly, instead of the conventional coolant pumps that are rigidly coupled to the engine speed, coolant pumps having a variable rotational speed and thus a controllable flow rate are increasingly being used.

For this purpose the applicant has already discussed an exemplary electric coolant pump in the application DE 100 47 387. This well-tried electric coolant pump has persistently been developed further by the applicant. An improved electric coolant pump based thereon and including an integrated directional control valve is described in DE 102 07 653.

The electric coolant pump having an integrated directional control valve as discussed comprises a coolant pump housing provided with an intake pipe for the supply from the radiator, a bypass pipe for the supply from the bypass circuit, and a pressure pipe for supplying or returning the coolant to the automotive vehicle engine. Inside the coolant pump housing a coolant pump electric motor is arranged, the motor housing of which is situated in the flow of circulated coolant. Via a pump shaft the pump motor drives a pump impeller in order to circulate the coolant. Intake pipe and bypass pipe are integrated into the supply leading to the pump upstream of the directional control valve integrated into the coolant pump housing, so that in the opened condition of the directional control valve a mixture of cooler coolant arriving from the radiator and heated coolant arriving directly from the automotive vehicle engine is taken in by the pump impeller, and this coolant mixture is supplied or returned to the automotive vehicle engine past the pump motor towards the pressure pipe situated in a downstream location.

Even though this electric coolant pump with an integrated directional control valve has already found acceptance in practice, more recent investigations by the applicant have shown that the electric and/or electronic components incorporated in the coolant pump may, despite the flow of circulated coolant mixture around the electric motor housing, at least temporarily be exposed to an extremely high heat load.

Thus the maximum temperature of the coolant cooled by the radiator, present at the outlet of the latter, and flowing from there to the pump is, e.g., 113° C. This desired upper value was fixed by the automotive industry for designing automotive radiators. The intention was to ensure that during the operation of an automotive vehicle even in extremely hot regions such as in the desert, cooled coolant is available for the automotive vehicle engine within a temperature range, is supplied to the engine at a maximum entrance temperature of 113° C., and is still capable of sufficiently absorbing heat from the internal combustion engine and dissipating it to the radiator with a remaining temperature span of at least 7° C. to 17° C. up to an upper limit of 120° C. to a maximum of 130° C. that is permitted for conventional coolants.

Accordingly the temperature of the coolant taken away from the engine may easily reach 120° C. or even more in unfavorable cases, i.e., up to 130° C.

Furthermore in modern internal combustion engines a shorting or bypass circuit is provided, whereby heated coolant arriving from the engine may directly be returned to the engine by way of the coolant pump. Hereby it is intended to shorten the overall warm-up phase of the engine, for instance in cold starting, to reach a more rapid heating of the cylinder sleeve following cold starting, and to enable a feedback control of the optimum temperature in terms of tribology.

The electronic and electric components incorporated in coolant pumps, such as, e.g., the electric motor driving the pump impeller or the electronic components, sensors, transducers or control circuits permitting a control and/or regulation of motor speed, pump capacity, valve position or other functions, possess a limited temperature compatibility and may thus not be exposed to unlimited high temperatures. Components that may be purchased at a reasonable pricing, admitted in automotive engineering and available in sufficient numbers of pieces may partly only be operated up to 120° C. at maximum. Above this temperature a rapid thermal death of such electric and/or electronic components is imminent. Accordingly, for instance when the coolant of the bypass circuit possibly heated up to 130° C. is circulated by the coolant pump, it is conceivable that the electric and/or electronic components of the coolant pump are exposed to a heat load that leads to a failure of these components.

Furthermore the two switching positions of a 3/2-way directional valve as, e.g., in the case of the electric coolant pump discussed in DE 102 07 653, were in part not considered satisfactory for comprehensive applications by the automotive industry.

Accordingly it is an object of the present invention to propose, while avoiding the above mentioned drawbacks, a convection-cooled electric coolant pump with an integrated directional control valve, wherein a risk of overheating of the electronic and/or electric components incorporated therein does not exist. Moreover it is an object of the present invention to specify a method suited for this purpose.

This object is attained in terms of device technology through a coolant circuit of an automotive internal combustion engine and a method for conveying coolant thereto.

Starting out from the electric coolant pump with an integrated directional control valve as described in DE 102 07 653, what is being proposed is an improved coolant pump of this type. The newly proposed coolant pump for a coolant circuit of an automotive internal combustion engine including at least a radiator circuit and a bypass circuit is provided with a coolant pump housing having an intake pipe for the supply from the radiator, a bypass pipe for the supply from the bypass circuit, and a pressure pipe for the supply of coolant from the automotive vehicle engine. Moreover the coolant pump is provided with a coolant pump electric motor arranged in the coolant pump housing, the motor housing of which is situated in the coolant flow, and which drives a pump impeller through the intermediary of a pump shaft. Furthermore the coolant pump comprises a directional control valve integrated in the coolant pump housing.

Here it is proposed for the first time to arrange the intake pipe in the area of the end of the pump motor facing away from the pump impeller. Moreover it is proposed for the first time to arrange the bypass pipe in an area situated downstream of the intake pipe, in particular downstream of the pump motor. Furthermore it is proposed to arrange the pressure pipe in an area situated downstream of the bypass pipe, in particular downstream of, or in an area around, the pump impeller; finally it is proposed for the first time that only the coolant that can directly be taken in by the radiator via the intake pipe for the supply may be taken past the pump motor in a peripheral flow through a flow channel preferentially defined by the outer wall of the pump motor housing and the facing inner wall of the pump housing and/or the facing inner wall of the directional control valve, so that the pump motor as well as the other electronic and/or electric components may thus be cooled optimally.

In the coolant pump in accordance with the invention, other than in known electric coolant pumps comprising an integrated directional control valve, the direction of flow through the pump is for the first time reversed, i.e., the cooled coolant arriving from the radiator, in particular a liquid, water-based coolant, is supplied to the pump from the rear, as it were. Thus the cold coolant arriving from the radiator at first flows past the pump motor and absorbs its waste heat to thus cools it down to admissible operating temperatures readily compatible with the electric motor, before the coolant arriving from the radiator is optionally mixed with the hot coolant supplied from the bypass circuit, and this coolant mixture is accelerated or circulated by the pump impeller and taken away or returned to the automotive vehicle engine via the pressure pipe.

Electronic components and/or electric components may thus advantageously be employed in the coolant pump, the temperature compatibility of which ends in a limit range of about 115° C. to 120° C. Namely, owing to the maximum temperature of 113° C. of the coolant arriving from the radiator, overheating of these parts and/or components is for the first time generally precluded.

In view of the maximum radiator temperature fixed by the automotive vehicle industry, even when an automotive vehicle is operated in hot regions such as, e.g., in the desert, a sufficient heat dissipation from the automotive vehicle engine is ensured without having to fear that the temperature limit of 120° C., which is critical for some components, will be exceeded, so that ultimately it is advantageously possible to even provide for the electric coolant pump electronic components or electric components that are threatened by thermal death not only from 120° C. but that may, e.g., only be operated reliably up to a maximum of 115° C. As a result it is possible to incorporate substantially more cost-efficient electronic components.

The coolant pump in accordance with the invention is moreover characterized by its enhanced sturdiness, an expanded range of use, and clearly reduced manufacturing costs. The convection-cooled, or coolant-cooled, electric coolant pump in accordance with the invention is a low-cost and particularly reliable alternative in comparison with known solutions existing on the market.

Moreover larger-size or more powerful electric motors may for the first time be employed. It is true that these do frequently produce a higher heat load, which may, however, readily be dissipated thanks to the quantity of cool coolant that in accordance with the invention is always available at the electric motor. The capacity limit hitherto considered insurmountable in the automotive vehicle coolant pump construction, with a maximum power consumption of 500 W at a battery voltage of 12 V, thus for the first time does not constitute an insurmountable barrier any more.

Advantageous developments of the invention result from the features of the subclaims.

In a preferred embodiment it is provided that the coolant of the bypass circuit that may be taken in through the bypass pipe may be admixed to the coolant arriving from the radiator circuit downstream of the pump motor with the aid of the directional control valve. To this end, an outlet of the bypass pipe adapted to be opened and closed again with the aid of the directional control valve is disposed in an area upstream of the pump impeller, so that the coolant mixture of cooled coolant arriving from the radiator and heated coolant arriving from the bypass may jointly be accelerated or circulated by the pump impeller. In a further preferred embodiment it is provided that the outlet of the directional control valve is disposed in an area between the pump impeller and the downstream end of the flow channel.

Hereby it is ensured that the cooled coolant arriving from the radiator is fully available in a pure or unmixed condition for the pump motor to cool it, and optionally moreover for cooling other electric and/or electronic components arranged in the area of the pump motor. In addition it is furthermore ensured that an introduction of heat through the heated coolant arriving from the bypass circuit into the cooled coolant arriving from the radiator circuit will only take place downstream of the coolant pump electric motor, and thus a temperature of the mixture that is desired or demanded by the engine management may purposely be adjusted or controlled without affecting optimum cooling of the pump motor.

In a further preferred embodiment it is provided that the pump motor and the pump shaft are arranged coaxially with the longitudinal axis of the pump housing. Even though constructive alternatives are conceivable where the pump shaft is arranged coaxially with the longitudinal axis of the pump motor, this group of components is nevertheless arranged asymmetrically or eccentrically in the pump housing, these may possibly provide pricing advantages in the manufacture of the housing. Nevertheless the concentric or coaxial variant is preferred inasmuch as it has a substantially more simple structure, its construction may be implemented more easily due to its symmetries, and it offers the greatest advantages in terms of flow technology while presumably also representing the most favorable solution in terms of costs.

In a further preferred embodiment it is provided that the flow channel defined by the outer wall of the motor housing enclosing the pump motor and the facing inner wall of the pump housing has an annular cross-section. Thanks to this annular flow channel, coolant that may be taken in via the supply from the radiator in a cooled condition may—starting from the end of the pump motor facing away from the pump impeller—be taken past the pump motor in a peripheral flow annularly enclosing the motor housing. Thus the heat produced by the electric motor is advantageously dissipated homogeneously all around. A heating occurring in spots or partial surfaces, or even so-called "hot spots" are hereby precluded. This ensures a permanently reliable operation at temperatures that are compatible for the pump motor.

In accordance with a further preferred embodiment it is provided that the flow channel has a constant cross-section in the direction of flow. Here a constriction from the diameter present at the end of the flow channel to the diameter of the pressure pipe takes place from the downstream end of the pump motor to the pump impeller. Hereby a variant is specified that is particularly favorable in rheological terms. The cool coolant taken in from the radiator by the coolant pump may flow past the pump motor without any flow loss whatsoever at a constant cross-section, at the same time cool the pump motor in an optimum manner, and then be taken in by the pump impeller through the constriction at the end of the flow channel or supplied to the pressure pipe an accelerated condition, wherein at the same time bundling of the entire flow volume towards the pump impeller takes place as a result of the constriction, and moreover a acceleration of the coolant in terms of flow mechanics takes place. Furthermore pressure losses are advantageously avoided, and undesirable turbulences are precluded.

In a further preferred embodiment the directional control valve may be switched continuously from a closed position of "bypass closed" into an open position of "bypass open."

Thus not only the advantages of the 3/2-way valve already known from DE 102 07 653 are utlized, but these advantages are expanded by the option of continuous control of the valve. Thus it is possible to adjust any temperature mixing ratio of cool coolant and hot bypass coolant that is desired or demanded by the thermal management for the automotive vehicle engine. The engine management or thermal management of the automotive vehicle engine may thus actively adjust optimum operating conditions for the engine.

In a further preferred embodiment, the directional control valve has the form of a valve spool slidingly displaceable in the longitudinal direction of the coolant pump. In a particularly preferred embodiment the valve spool has the form of a cylindrical sleeve. The latter may, for instance, be made of metal. As an alternative it is conceivable to also form the valve spool of plastics or the like. Here it is possible to use plastics that are also employed, e.g., for manufacturing the coolant pump housing.

The coolant pump housing as well as the valve spool may, e.g., in a particularly advantageous manner be manufactured by the plastics injection molding technique. Post-processing of these components advantageously is not necessary.

The directional control valve equipped with a valve spool furnishes the further advantage of a fail-safe position so that the radiator inlet will in any case be open in the case of a failure of the valve. Moreover it is characterized by an extremely low differential pressure ideally tending towards zero. Advantageously no pressure drop occurs thus at the valve spool, which ultimately has the effect that a very low switching power is even sufficient for switching or operating the valve.

This positive effect is further enhanced by the fact that the valve spool has particularly low frictional or movement losses owing to the direction of movement that is in parallel with the main direction of flow of the coolant arriving from the radiator and flowing past the pump motor and the valve spool.

It is another advantage of the valve spool that it may be formed without any leakage. In contrast, in the case of rotary valves a leakage can never be avoided entirely as a result of the parts being moved transversely to the main direction of flow.

Furthermore the coolant pump in accordance with the invention furnishes the further advantage that a low pump capacity is already sufficient for achieving a desired coolant throughput. Thus it is also possible to use pump motors having a low consumption of electric power.

Moreover the coolant pump in accordance with the invention furnishes the further advantage that in the valve position of "radiator open" no reduction of the maximum open cross-section ensues, so that for this reasons, too, a low flow rate is sufficient for circulating the coolant, so that the electric pump may for this additional reason be manufactured to have a lower power consumption in comparison with commercially available electric pumps.

In a further preferred embodiment, displacement of the valve spool may be power-operated with the aid of an actuator such as, e.g., an operating solenoid, a thermally expandable element, a hydrostatic pressure member, or the like. The like actuators are characterized by a very low wear tendency, furnish a long service life or particularly high switching cycles, and are available at lost cost. Moreover such actuators operate with extreme reliability and are largely not prone to defects.

In accordance with a further preferred embodiment, the valve spool has in the area of the supply for the coolant fed from the bypass circuit via the bypass pipe a radially inwardly directed seal which, in the closed condition of the directional control valve, closes off the outlet thereof by a valve seat sealing against an annular seal seat of the pump housing.

The seal may be an elastomer seal, for instance. The annular seat support ensures absolutely tight closing. Secondary leakages are avoided. A constriction of the distribution paths, irrespective of whether the directional control valve is in the position of "bypass closed" or in the position of "bypass open", is avoided even in intermediary positions. Hereby a valve variant is specified that is particularly favorable in rheological terms. Moreover a cylindrical sleeve may be sealed in a particularly simple manner in a cylindrical housing, so that for this additional reason, too, secondary leakages are avoided.

An additional advantage of the valve spool executed as a cylindrical sleeve is its relatively simple kinematics, so that a switching movement in the longitudinal direction may readily be implemented. This furnishes the additional advantage that continuous mixing of bypass and supply may be realized by a simple linear movement, i.e., a longitudinal displacement, so that there exists a direct, in particular linear, relationship between valve position, or outlet opening, and the mixing ratio as well as the current position of the valve spool, which may accordingly be mapped easily in terms of control technology and without any particular complexity.

In a further preferred embodiment, the radially inwardly facing surface of the seal has a contour corresponding to the opposite contour of the motor housing. Thus the flow of coolant through the flow channel portion thereby formed may be optimal, in particular laminar. Flow losses are avoided. Turbulences are avoided.

In accordance with a further preferred embodiment, the operating solenoid of the valve spool includes an armature formed by the cylindrical sleeve of the valve spool. This results in an advantageous twofold use of the valve spool. On the one hand it is a part of the valve, and on the other hand it is at the same time a component of the operating solenoid. This helps to further reduce costs and enhances reliability thanks to the reduced variety of parts. This twofold function may in a particularly favorable manner be provided by a valve spool executed in metal. As an alternative, a valve spool made of plastics may in some areas thereof also have metallic portions serving as an armature.

Accordingly it is provided in a further preferred embodiment that the operating solenoid includes a coil carrier that is arranged in the pump housing and encloses the armature. The armature formed by the valve sleeve may be fully enclosed by the coil carrier. The coil carrier may thus optimally co-operate with the armature and move the latter even at low magnetic forces, so that the valve sleeve may be extended and retracted in the longitudinal direction with relatively ease in comparison with conventional valves. The cylindrical valve sleeve may be guided while being sealed radially outwardly against the solenoids by means of rod seals or the like, so that secondary leakages can equally not occur in this location. Hereby a particularly cost-efficient embodiment of a reliable, continuously adjustable directional control valve variant is specified.

In a further preferred embodiment it is provided that downstream following the bypass pipe and still upstream of the pump impeller, a return flow, e.g. for a heating circuit, a transmission oil heat exchanger, a lubricant oil heat exchanger, a separate cylinder block cooling circuit or the like, merges into the pump housing. Thus additional secondary circuits supplementing the coolant circuit or the engine thermal management may in an advantageous manner jointly be covered by the electric coolant pump in accordance with the invention, and the partial quantities of coolant flowing there may jointly be conveyed by the coolant pump. Such a return flow may directly be coupled to the pump housing without a valve or, where necessary, have a valve for a specific control thereof, in which case an adapted form of the above discussed directional control valve may advantageously be employed.

In a further preferred embodiment the pump housing is constructed in two parts. This enables a simplified construction of the electric coolant pump. Its assembly is facilitated. In a further preferred embodiment it is provided that the operating solenoid has coil terminals oriented in the longitudinal direction, which may by means of correlating terminals advantageously be taken into contact with control means accommodated in the other housing part such as a CPU, a control unit or the like, while the two housing parts are joined together. This additionally facilitates assembly.

Not least it is provided in a further preferred embodiment that in addition to driving the pump impeller by the coolant pump electric motor, a drive wheel is provided which is arranged coaxially with the pump shaft externally of the pump housing and coupled to the pump shaft via a free-wheel. Thus the coolant pump may be driven primarily mechanically via a pulley situated outside the pump housing or the like. The pulley is uncoupled from the pump shaft in terms of drive technology with the aid of a free-wheel. At rest and at low speeds a low-cost motor may drive the pump at a constant speed. At higher speeds the pulley then overtakes the electric motor. This furthermore furnishes the advantage that the coolant pump in accordance with the invention may even be employed in low-power on-board networks. This alternative is substantially more cost-efficient in comparison with expensive brushless drive motors. A pump capacity guaranteeing the required basic capacity is thus ensured even in the event of a failure of the electric motor.

Finally it is provided in a further preferred embodiment that the directional control valve, or its valve spool, may be actuated or switched hydraulically with the aid of a thermally expandable element.

To this end it is provided that the thermally expandable element has the form, e.g., of a wax member whose volume change as a result of a change of the temperature prevailing in the passing coolant brings about a volume change in an adjacent, separate transfer medium such as a water/glycol mixture that may also be utilized as a coolant. This separate transfer medium is separated from the wax member, e.g., by a flexible diaphragm. The volume change in the transfer medium is transferred via corresponding conduits, connecting bores or connecting passages to a cylinder chamber of the valve spool, so that the latter may be actuated hydraulically. A resetting force may be applied to the valve spool by means of a spring or the like.

In another preferred embodiment it is provided that the thermally expandable element is formed of wax. Its fusion point is approximately 85° C. Its temperature-dependent volume change may then be transferred via a separate coolant and associated connection lines to the hydraulically actuatable valve spool.

In accordance with a further preferred embodiment, the thermally expandable element formed of wax is to be arranged in an area in the pump housing adjacent the pressure pipe. It may be contiguous with the passing coolant through the intermediary of a metallic inner wall arranged radially inside of the thermally expandable element and having, e.g., the form of a metallic cylinder jacket. The thermally expandable element may be separated from the associated, separate coolant through a diaphragm arranged radially outside of it, such that a temperature-dependent volume change of the thermally expandable element may be transferred to the coolant. The separate coolant may in turn be displaced via the connection lines into a cylinder chamber of the valve spool thus adapted to be actuated hydraulically.

What is proposed hereby is a method for conveying coolant by means of a coolant pump for a coolant circuit of an automotive internal combustion engine comprising at least a radiator circuit and a bypass circuit. The method comprises the following steps: a) supplying the coolant from the radiator to the coolant pump through an intake pipe of the coolant pump housing, b) supplying the coolant from the bypass circuit to the coolant pump through a bypass pipe, c) returning the coolant from the coolant pump to the automotive vehicle engine through a pressure pipe, d) circulating the coolant by means of a pump impeller driven by a coolant pump electric motor via a pump shaft, wherein the engine is situated in a flow of coolant, e) adjusting the mixing ratio of the coolant flows circulating through the coolant pump by means of a directional control valve integrated into the coolant pump housing.

Here it is proposed for the first time to supply the coolant arriving from the radiator via the intake pipe in the area of the end of the pump motor facing away from the pump impeller, wherein the coolant arriving from the bypass is supplied via the bypass pipe in an area located downstream of the intake pipe, and wherein the coolant is taken away via the pressure pipe in an area located downstream of the bypass pipe. Only the coolant supplied from radiator through the intake pipe is to be taken in a peripheral flow past the pump motor through a flow channel defined in particular by the outer wall of the pump motor housing and the facing inner wall of the pump housing and/or the facing inner wall of the directional control valve.

Thus an effective and reliable cooling of the pump motor is advantageously possible. Furthermore the advantages already discussed above may also be obtained through the method.

In the coolant pump in accordance with the invention, temperature detection of the mixed coolant takes place in the pump housing outlet leading to the automotive vehicle engine, i.e., in the area of the pressure pipe. Thus it is made sure that a sufficient quantity of coolant having the demanded temperature will always be supplied to the automotive vehicle engine. Quantity and temperature of the coolant flowing through the pressure pipe are regulated in accordance with the temperature and quantity of hot coolant supplied from the bypass, the coolant cooled by the radiator and supplied from the supply, the amount of heat introduced by the electric motor, and optionally a heating return flow or some other return flow such as, e.g., additional heated coolant supplied from a lubricant oil heat exchanger or a cylinder block cooling circuit. Accordingly the CPU or control unit of the pump may output instructions or voltage signals to the coil carrier and to the pump motor, so that the desired or required valve position is adjusted continuously, and a sensed motor speed is detected. A correspondingly miniaturized or adapted variant of the sliding valve may be utilized for controlling the return flow from a heating, a transmission oil heat exchanger, or the like.

In the coolant pump in accordance with the invention, the coolant pump housing is enlarged by the valve function. Thus the functionality of the coolant pump is enhanced, and at the same time the constructive complexity is reduced, resulting in lower expense for assembly, and lastly in a reduced price. Here the split design of the housing additionally helps to reduce the costs, for owing to the split housing design a more simple assembly of the individual components is possible.

The pump impeller arranged on the pump shaft downstream in the direction of flow after the pump motor has, for instance, a impeller and a runner. The principle employed here corresponds to the principle of the well-tried axial pump principle mentioned that is successfully distributed by the applicant. The demanded, narrow air gap is processed in a clamped condition, so that the required accuracy is ensured and post-processing is suppressed.

Control of the coolant pump in accordance with the invention is designed such that even in the case of a closed coolant circuit, i.e., with an open bypass circuit, overheating of the electric motor is not imminent. In the valve positions of "bypass open" and "radiator supply closed", the cooled coolant arriving from the radiator is present as far as the downstream end of the pump motor housing and encloses the pump motor, or the housing thereof, respectively. Thus the coolant may even in the worst case, at a maximum of 113° C., still accommodate a temperature interval of at least 7° C. until 120° C. are reached and thermal death of component parts is imminent. The control unit of the pump makes sure that this case can not occur. If overheating should be imminent in this switching position, the control unit ensures that the valve is temporarily taken into a position of "supply from the radiator open" and "bypass closed", the coolant present flows temporarily, and the valve is again returned into its home position, so that afterwards fresh, fully cooled coolant from the radiator again encloses and cools the electric pump. Accordingly even in cold starting with the switching position of "bypass open" then present for some time, which is selected in order to keep the warm-up phase of the automotive internal combustion engine as short as possible, no danger to the electronic components need be feared.

Thanks to the sliding seat valve variant, any mixtures are possible. The sliding seat valve may be adjusted continuously. There is no formation of movement gaps that would be difficult to seal. The seal ring which may, e.g., be an elastomer seal ring, axially contacts the seal seat of the housing in the position of "bypass closed." Accordingly, in a position of "supply from the radiator closed", the elastomer seal ring conversely contacts the housing of the electric motor in a tightly sealing manner. Movement gaps do not exist. Secondary leakages are avoided.

The solenoid is mounted relative to the valve sleeve through rod seals having a scraping function. Thus secondary leakages are equally avoided.

The valve sleeve is spring-biased, for example, or subjected to a basic force by alternative means, so that in the case of a defect of the electronic system, the valve automatically shifts to a position of "supply from the radiator open" and "bypass closed." Hereby a fail-safe position is ensured which makes sure that the automotive vehicle engine cannot overheat.

The housing of the pump motor may be manufacture of metal, e.g. of aluminum or a some other, noble metal that conducts heat particularly well. Thus an optimum heat dissipation from the electrically operated pump motor to this peripheral flow of coolant is ensured.

In the currently preferred coolant pump variant, the bypass and the heating return flow are fed radially or tangentially from the outside to the pump center in the area in which temperature is not critical.

BRIEF DESCRIPTION OF THE DRAWINGS

The above described invention shall in the following be explained in more detail through embodiments by referring to the figures of the drawing, wherein.

DETAILED DESCRIPTION OF THE DRAWINGS

Figure 1:
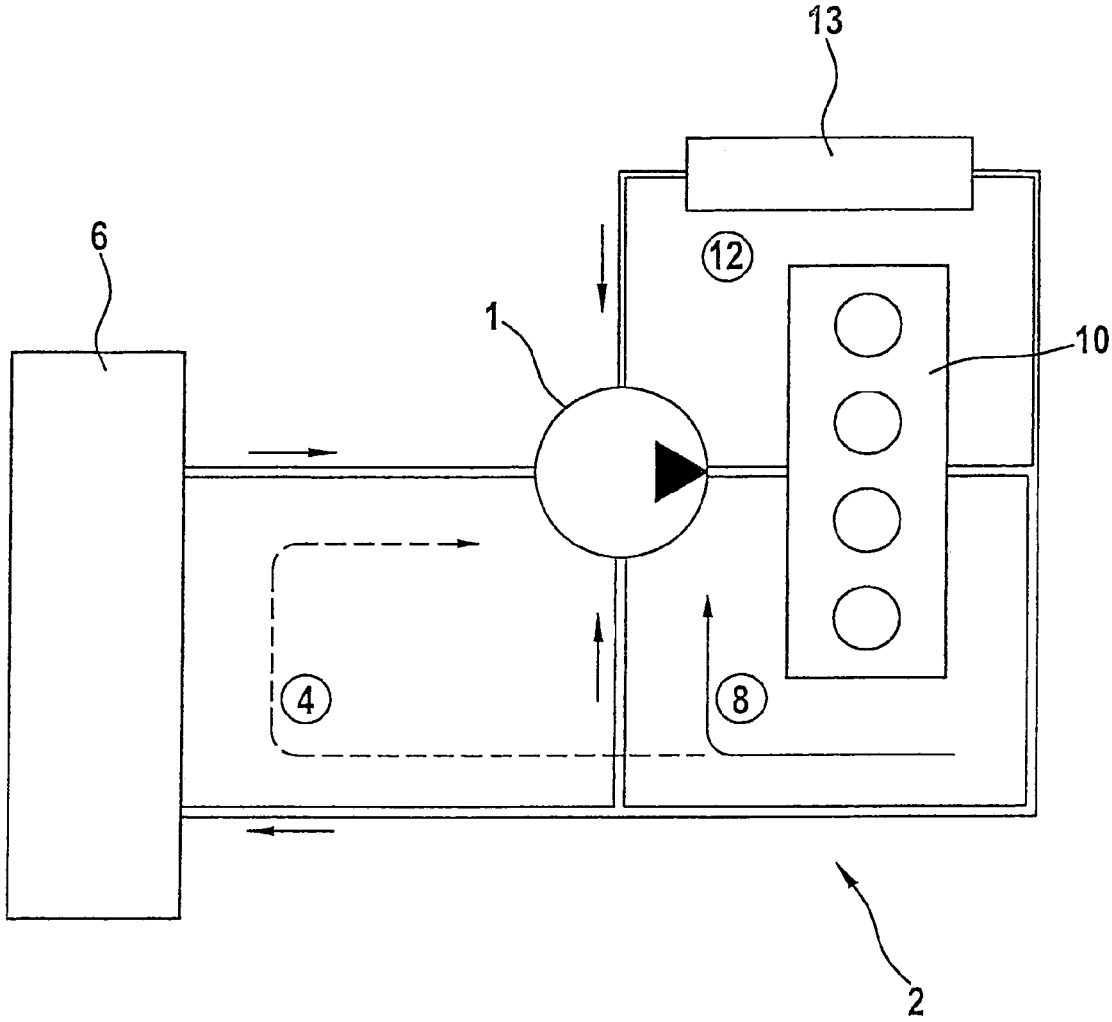
FIG. 1 is a schematically simplified representation of a association of the cooling circuits with an exemplary use of the electric coolant pump comprising an integrated directional control valve.

FIG. 1 is a circuit diagram for an exemplary association of circuits in the thermal management for an automotive vehicle engine including the above discussed coolant pump is shown in a schematically simplified representation. The electric coolant pump 1 is integrated into a coolant circuit 2. The coolant circuit 2 includes a radiator circuit 4 passing across a radiator 6. Furthermore the coolant circuit 2 includes a shorting circuit or bypass circuit 8 establishing a shorted connection of the engine 10 directly with the coolant pump 1. Moreover an exemplary heating circuit 12 from the engine 10 via a heating 13 to the electric coolant pump 1 back to the engine 10 is shown. Additional secondary circuits, such as a coolant secondary circuit for a transmission oil heat exchanger, for a lubricant oil heat exchanger, a separate cylinder head circuit and a separate engine block circuit or the like are conceivable, however presently not represented.

The electric coolant pump 1 including an integrated directional control valve conveys, or circulates, the coolant taken in from the engine 10 in the radiator circuit 4 across the radiator 6 back to the engine 10. Furthermore the coolant pump 1 conveys the coolant circulating in the shorting circuit 8. Furthermore the coolant pump 1 also circulates the coolant circulating in the heating circuit 12.

The electric coolant pump 1 comprising an integrated directional control valve, which is shown in schematic simplification as a symbol in FIG. 1, is explained in further detail by way of various variants in FIGS. 2 to 8.

Figure 2:
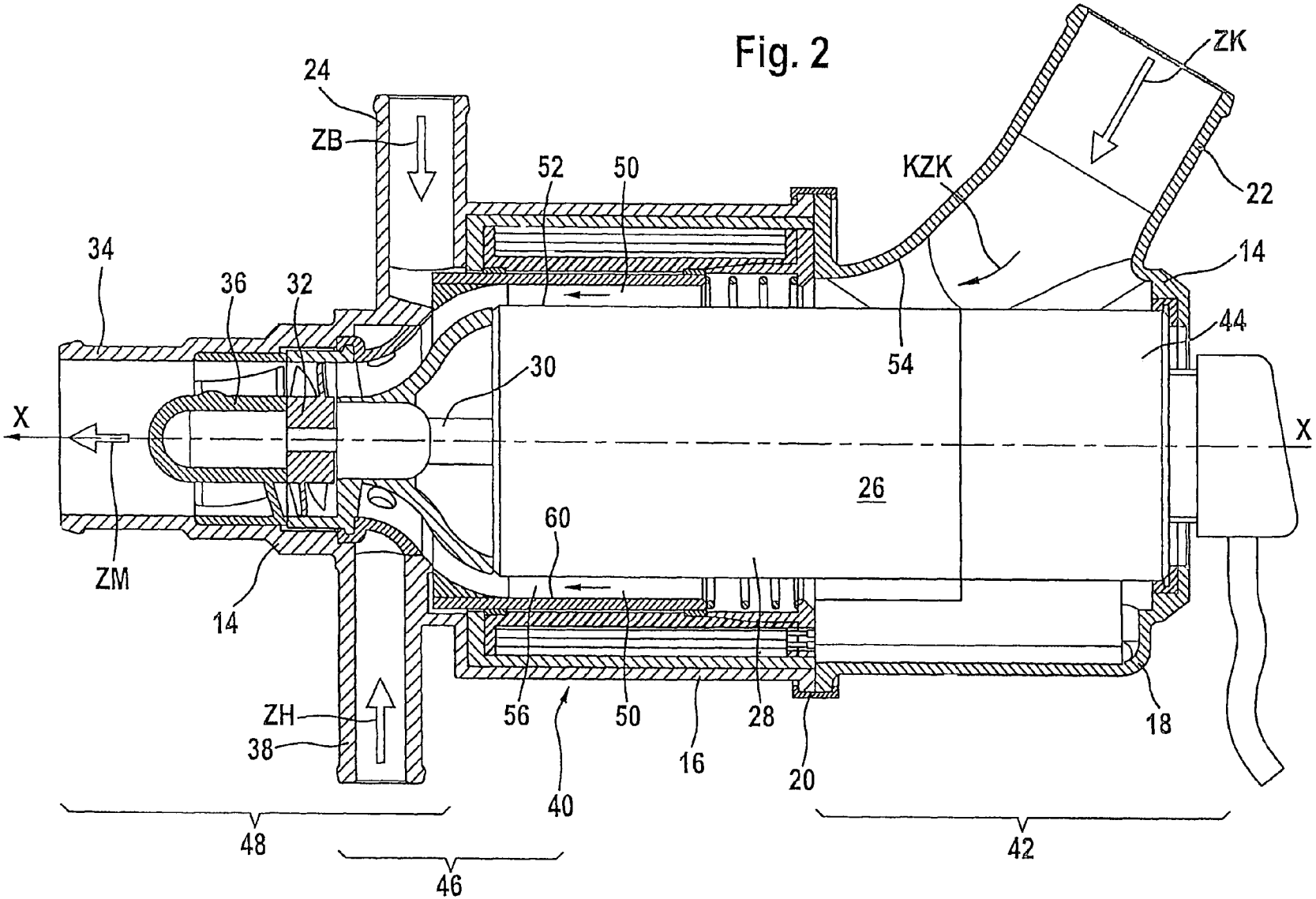
FIG. 2 is a longitudinal sectional view of an exemplary embodiment of the coolant pump, with the directional control valve assuming the position of "bypass closed" or "supply from the radiator open"

FIG. 2 shows a longitudinal sectional view of a first exemplary embodiment of a coolant pump 1. The coolant pump housing 14 is split into two parts in this embodiment. It consists of a first housing part 16 and a second housing part 18. Both housing parts 16 and 18 are tightly connected to each other in a tightly sealing manner by an annular clasp, clamp, or bracket 20. The housing 14 may also be executed in three or more parts, or also in one part having a lid.

The coolant KZK arriving in the radiator circuit 4 from the radiator 6 is supplied to the pump housing 14 via the intake pipe 22. This is symbolized by the arrow ZK pointing from the radiator 6 to the pump housing 14.

The coolant heated by the automotive vehicle engine 10 and arriving from the bypass or shorting circuit 8 via the supply ZB symbolized by an arrow, is supplied to the pump housing 14 via the bypass pipe 24.

Inside the coolant pump housing 14, a coolant pump electric motor 26 is arranged. Its motor housing 28 is situated inside the flow of passing coolant so as to cool the electric motor 26. The pump motor 26 drives a pump impeller 32 through the intermediary of a pump shaft 30. In the variant shown here, the pump impeller 32, the pump shaft 30, and the pump motor 26 are arranged coaxially with the longitudinal axis X of the pump housing 14.

The coolant accelerated or circulated by the pump impeller 32 is conveyed off through a pressure pipe 34 for the supply ZM of the coolant, symbolized by another arrow, to the automotive vehicle engine 10.

In the represented embodiment the coolant pump 1 has in addition to the impeller 32 a runner 36 that is also arranged in the pressure pipe 34.

Moreover by way of example a heating return flow 38 is represented through which in turn supply ZH of the coolant from the heating circuit 12 symbolized by an arrow is made possible so as to circulate it by the pump 1.

Into the coolant pump housing 14 a continuously adjustable directional control valve 40 is integrated. The directional control valve may assume the position of "bypass closed" or "supply from the radiator open" presently shown in FIG. 2. It may continuously be taken from this position via a position of "bypass partly open" and "supply from the radiator partly open" (cf. FIG. 3) into a position of "bypass open" or "supply from the radiator closed" (cf. FIG. 4) and again be returned.

The intake pipe 22 is arranged in an upstream area 42 situated in the area of the end 44 of the pump motor 26 facing away from the pump impeller 32. The bypass pipe 24 is moreover arranged in an area 46 situated downstream of the intake pipe 22. Moreover the pressure pipe 34 is arranged in an area 48 situated downstream of the bypass pipe 24.

Thus it is ensured that only the coolant KZK taken in from the radiator 6 via the intake pipe supply ZK is passed by the pump motor 26 in a peripheral flow 50. The peripheral flow 50 is on the one hand defined by the outer wall 52 of the pump motor housing 28 and on the other hand by the facing inner wall 54 of the pump housing 14 so as to form a flow channel 56. The flow channel 56 is then, in the further continuation of the flow, defined radially outside by the inner wall or inner surface 60 of the directional control valve 40 facing the outer wall 52 of the pump motor housing 28, which inner wall connects to the housing inner wall 54 in the direction of flow in the area of the joint between the two housing parts 16 and 18.

Figure 3:
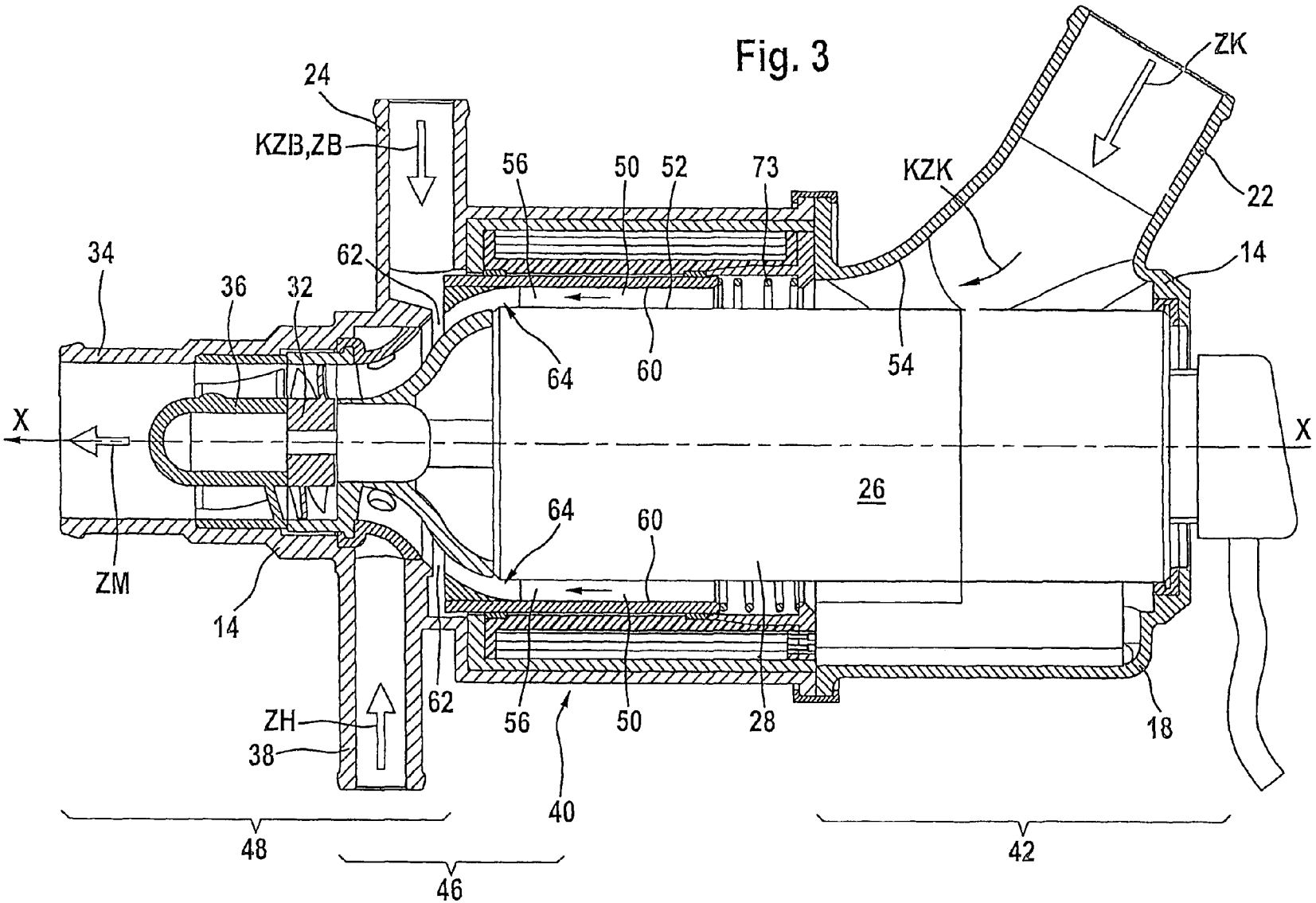
FIG. 3 is another longitudinal sectional view of the embodiment of the coolant pump of FIG. 2 in the valve position of "bypass partly open" or "supply from the radiator partly closed"
Figure 4:
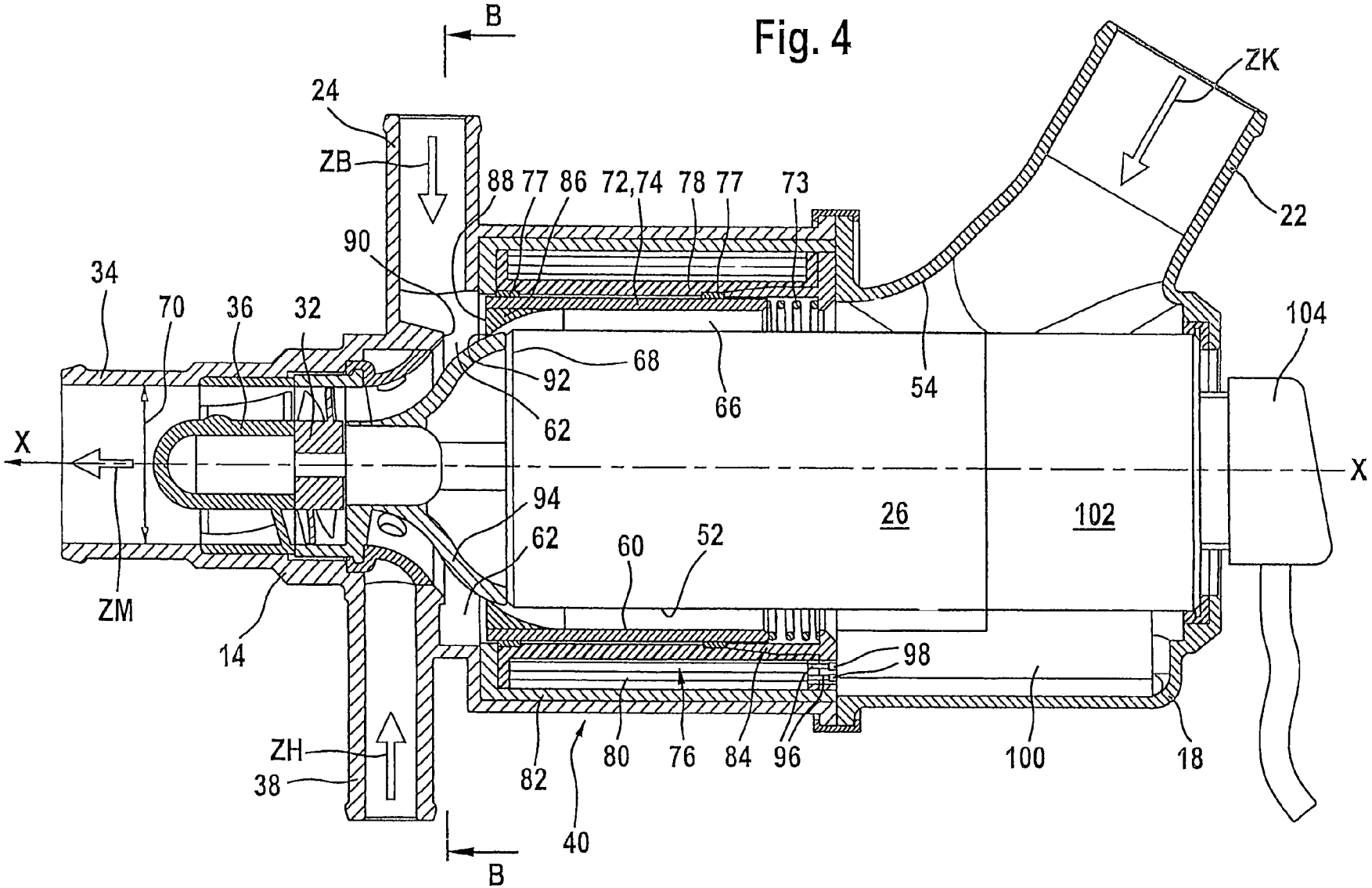
FIG. 4 shows the coolant pump variant of FIGS. 2 and 3 with the valve position of "supply from the radiator closed" or "bypass open"

The exemplary embodiment of a convection-cooled electric coolant pump 1 comprising an integrated directional control valve 40, which is represented in a longitudinal sectional view in FIG. 2, is again shown in a longitudinal sectional view in FIGS. 3 and 4, with FIG. 3 showing a partly opened position of the directional control valve 40, and FIG. 4 showing another position of the directional control valve 40 in which the supply from the radiator ZK is closed, and the supply from the bypass ZB is fully opened.

Admixing of the coolant KZK circulated by the coolant pump 1 and arriving from the radiator circuit 4 with the coolant KZB arriving from the bypass circuit 8 by way of the bypass pipe 24 takes place by means of the directional control valve 40. An outlet 62 of the bypass pipe 24 adapted to be opened and closed by means of the directional control valve 40 is arranged in the area 46 upstream before the pump impeller 32.

In the variant represented here, the outlet 62 is located between the pump impeller 32, or between the heating return flow 38 and the upstream end 64 of the flow channel 56.

Figure 5:
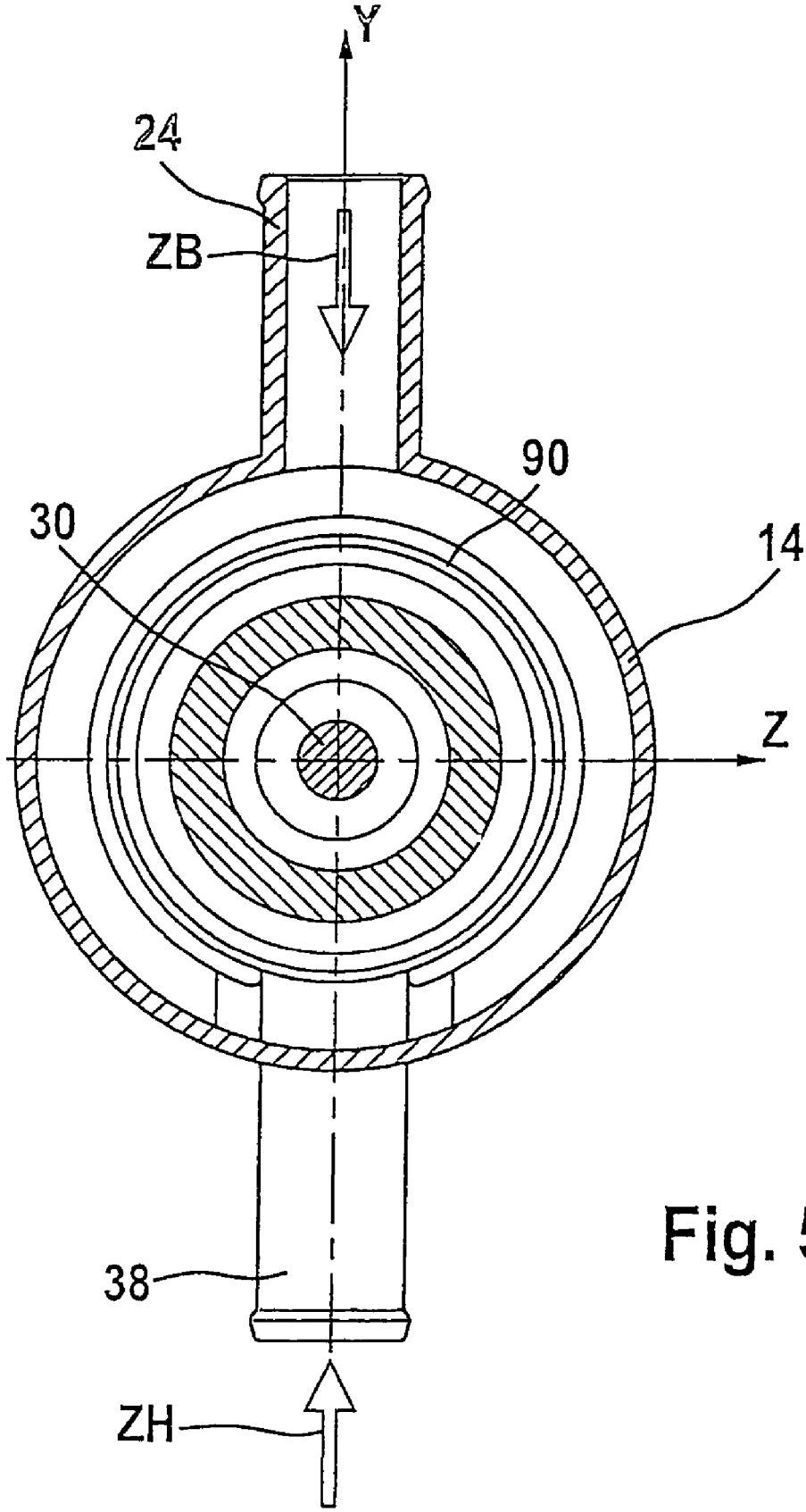
FIG. 5 is a sectional view of the coolant pump shown in FIG. 4 along the line B-B.

As is more clearly seen in FIG. 5, the supply ZB from the bypass circuit 8 and the supply ZH from the heating circuit 12 are arranged in a same plane, coaxial with the Y axis, radially opposite the longitudinal axis X that extends perpendicularly to the plane of the drawing. As an alternative the corresponding pipe may also be connected tangentially to the housing 14. This depends mainly on the construction space available for the pump 1 in the engine compartment, and on the positions of the feeds and drains.

Furthermore it may particularly well be seen from FIG. 5 in conjunction with FIGS. 2 to 4 that in the variant of the pump motor 26 shown here, the pump shaft 30, the pump impeller 32, the runner 36, and the pump housing 14 are arranged coaxial with the longitudinal axis X.

The flow channel 56 defined by the inner wall 54 of the pump housing 14 and/or by the inner wall 60 of the directional control valve 40 on the one hand, and by the outer wall 52 of the pump motor 26 on the other hand, has in a particularly preferred embodiment an annular shape, or an annular cross-section. Thus a peripheral flow 56 annularly enclosing the motor housing 28 is defined which flows past the pump motor 26 to thereby cool it optimally.

The flow channel 56 has a cross-section 66 that is constant in the direction of flow. From the downstream end 64 of the flow channel 56 or from the downstream end 68 of the pump motor 26 to the pump impeller 32, the diameter existing at the end of the flow channel 56 is continuously constricted down to the inner diameter 70 the diameter of the pressure pipe 34.

The directional control valve 40 has the form of a valve spool 72 slidingly displaceable in the longitudinal direction X of the coolant pump 1, which in the presently represented variant is constructed as a cylindrical sleeve. The valve spool 72 is biased by means of a spring 73 or some other suitable force-generating element, so that in the case of a failure of the valve control, the spring force of the spring 73 automatically takes the directional control valve 40 into a fail-safe position of "supply from the radiator open.".

The valve spool 72 is, in addition to its valve function, concurrently utilized as an armature 74 of an operating solenoid 76 actuating the valve spool 72. The valve spool 72 is guided on its radially external side and sealed against the housing 14 or against the additional adjacent components, respectively, by means of rod seals 77 having a scraping function.

The operating solenoid 76 comprises the above mentioned armature 74 and a coil carrier 78 arranged in the pump housing 14 and enclosing the armature 74. The armature 74 is formed by the cylindrical sleeve 72 in that the latter is made of metal. The sleeve 72 may also be made of plastics and include metallic portions forming the armature 74. On the coil carrier 78 the associated coil 80 is arranged. The coil 80 in turn is enclosed by a yoke 82 arranged radially outside the coil 80. Radially inside there is integrated another yoke 84 with influence on characteristic having an annular form and arranged between the coil carrier 78 and the armature 74. The rod seals 77 are also arranged between the coil carrier 78 and the valve spool 72 having the form of an armature 74, with a rod seal 77 connecting directly to the yoke 84.

The valve spool 72 has in the area of the bypass pipe 24 a radially inwardly directed seal 86. The seal 86 may be executed as an elastomer seal. Other sealing materials may also be used. In a closed position of "bypass closed" of the directional control valve 40, the seal 86 contacts by its planar annular end face 88, the normal line of which extends in parallel with the longitudinal axis X, a correspondingly formed annular seal seat 90 of the pump housing 14 so as to sealingly close it. In an open position of "bypass open", which accordingly may also be referred to as "supply from the radiator closed", the seal 86 sealingly closes by its radially inwardly facing annular tip 92 the supply from the radiator ZK at the end 68 of the electric motor 26 or at the end 64 of the flow channel 56 against the motor housing 28, or a connecting pump shaft housing 94. As an alternative for the seal 86, other sealing variants are also conceivable, whereby in an axial direction tight sealing of the directional control valve 40 against the housing 14 is possible, and whereby in a radial direction tight sealing of the directional control valve 40 against the pump shaft housing 94 or the pump motor housing 28 is possible. Such seals 86 may also have more than one seal seat or one or several seal lips or the like.

The operating solenoid 76 includes coil terminals 96 oriented in the longitudinal direction X, or in parallel with the X-axis. These coil terminals 96 correlate with corresponding contacts 98 of an electronic component that is integrated into the housing parts 18, such as, e.g., control means 100, a CPU, or the like, so that the control means 100 and the operating solenoid 76 may immediately and readily be taken into contact with each other during assembly of the two housing parts 16 and 18. In the housing part 18 an amplifier unit 102 is moreover accommodated. The latter may be connected from the outside to corresponding control circuits by means of a connector 104.

Figure 6:
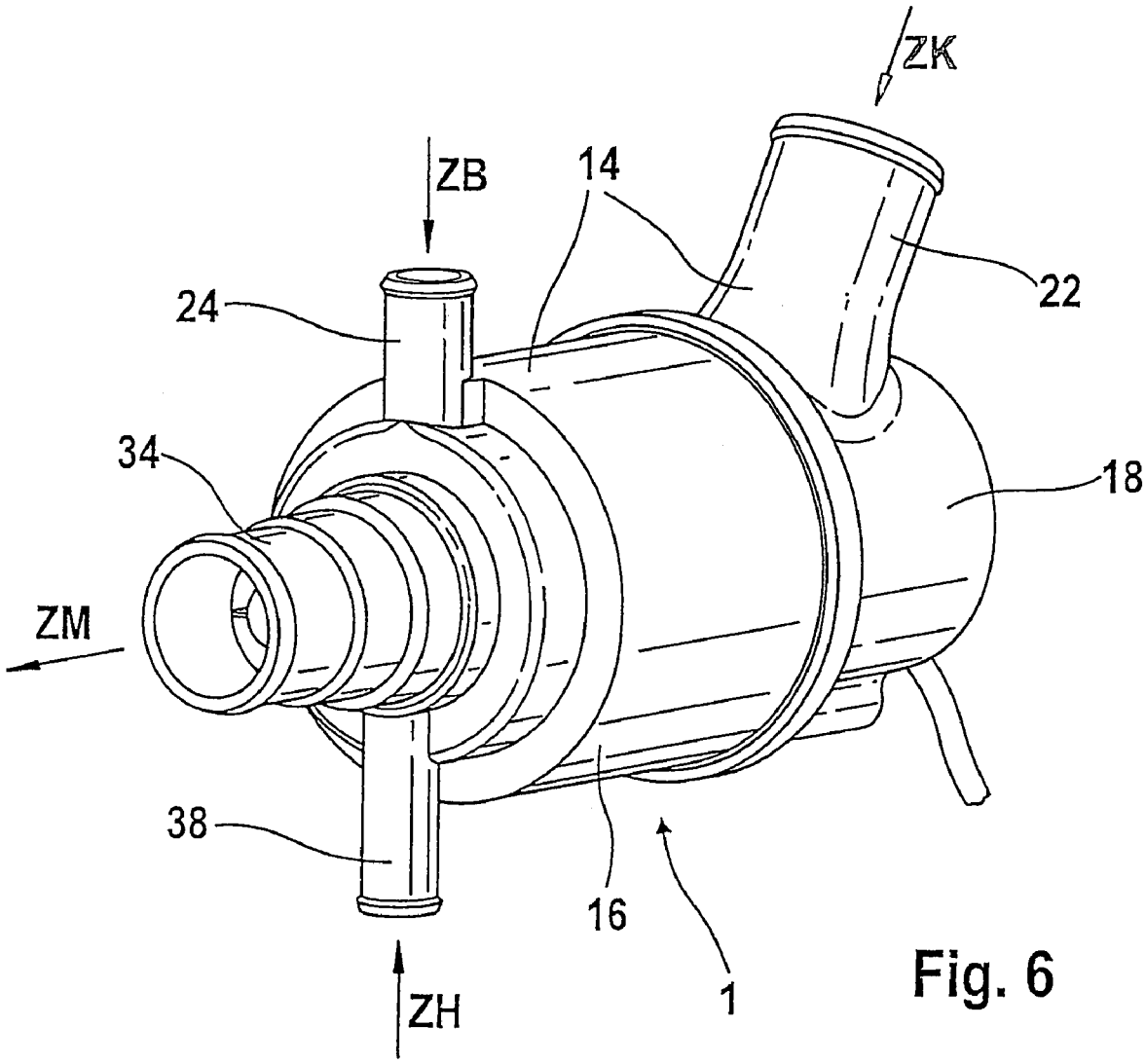
FIG. 6 is a three-dimensional view of the pump shown in FIGS. 2 to 5.

The exemplary embodiment of a coolant pump 1 as represented in FIGS. 2 to 5 is illustrated in FIG. 6 in a three-dimensional view for a better understanding of the spatial association of the pipes or components.

Figure 7:
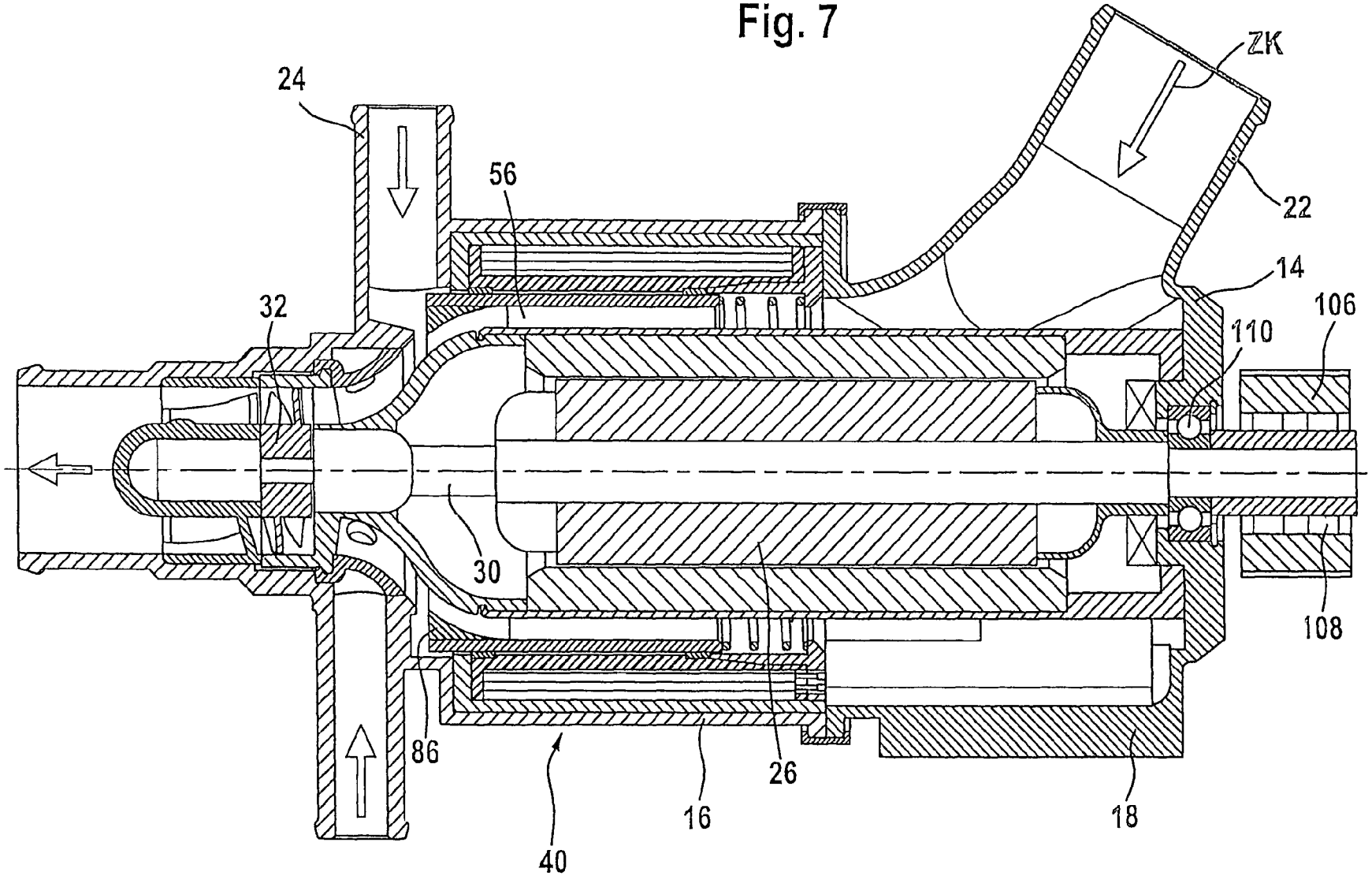
FIG. 7 is a longitudinal sectional view of another variant of the pump.
Figure 8:
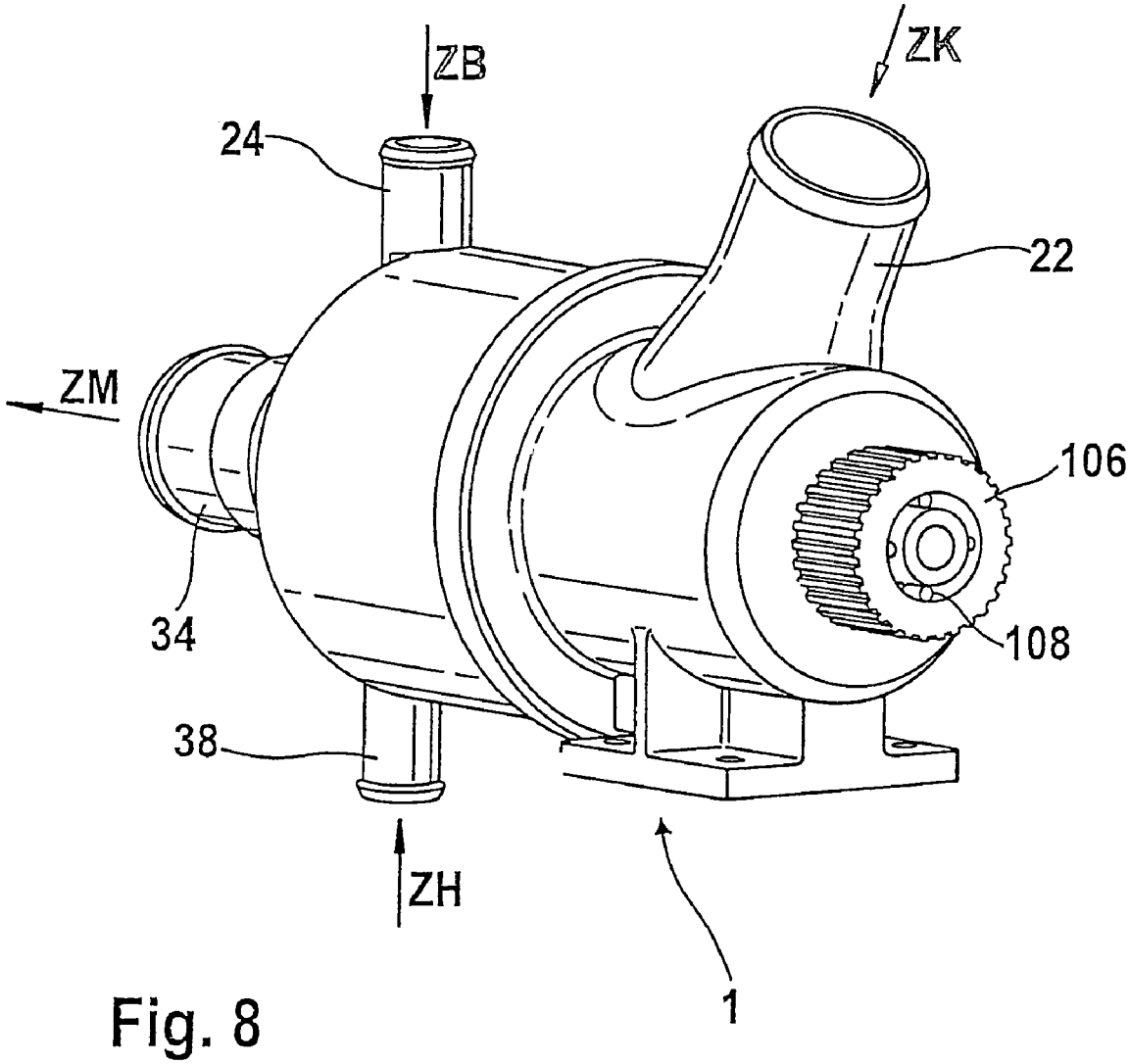
FIG. 8 is a three-dimensional view of the further variant in accordance with FIG. 7.

In FIGS. 7 and 8 another exemplary embodiment of a coolant pump 1 is shown. Components that are identical or have a same effect are provided with the same reference numerals as already used in FIGS. 2 to 5.

The coolant pump 1 shown in FIG. 7 has in addition to the drive mechanism of the pump impeller 32, supplementarily for the coolant pump electric motor 26, a drive wheel 106 arranged externally of the pump housing 14. The drive wheel 106 is oriented coaxially with the pump shaft 30 and may be mechanically coupled with the pump shaft 30 through the intermediary of a free-wheel 108. The pump shaft 30 has an additional bearing 110 in the end of the right-hand housing part 18 in accordance with this representation. Via the drive wheel 106 the pump impeller 32 may in addition to the electric motor 26 be driven externally, e.g. by a belt or a gear drive. Thus the coolant pump 1 may be driven primarily mechanically by the drive wheel 106 having the form, e.g., of a pulley. The drive wheel 106 is to this end uncoupled from the pump shaft 30 by means of the free-wheel 110. At rest and at low speeds of the internal combustion engine, a low-cost electric motor, for instance, drives the pump at a constant speed. At higher speeds of the internal combustion engine, the drive wheel 106 overtakes the electric motor. This pump variant may also be used in low electric power on-board networks. It represents a low-cost alternative in comparison with costly brushless drive motors. A pump capacity is ensured even in the event of a failure of the electric motor.

The variant of the coolant pump 1 represented in a longitudinal sectional view in FIG. 7 is illustrated in a three-dimensional view in FIG. 8 for a better comprehension of the spatial association of the components.

Figure 9:
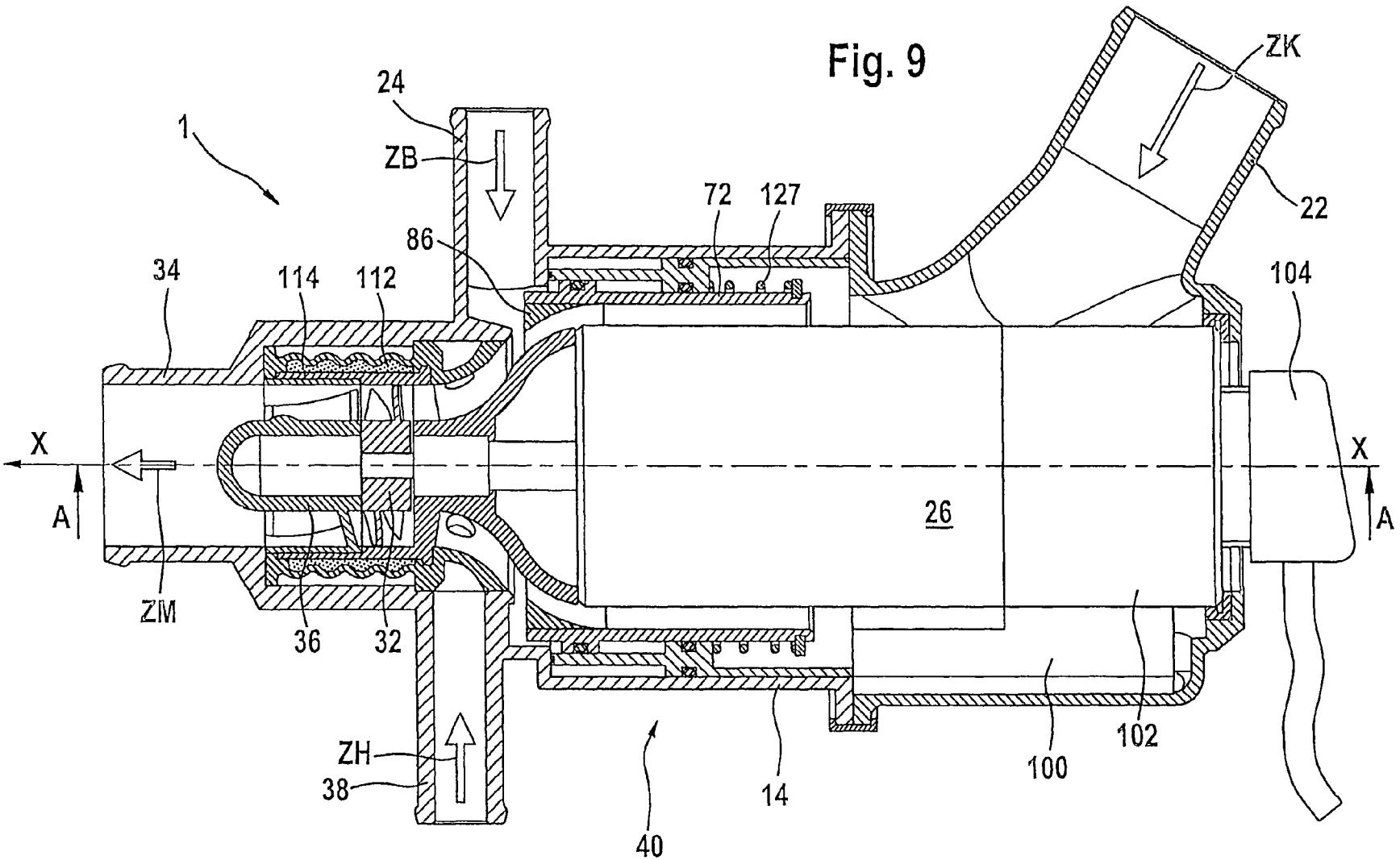
FIG. 9 shows another variant of the coolant pump shown in FIGS. 1 to 8 adapted to actuation of the directional control valve by means of a thermally expandable element, represented in the longitudinal sectional view.
Figure 10:
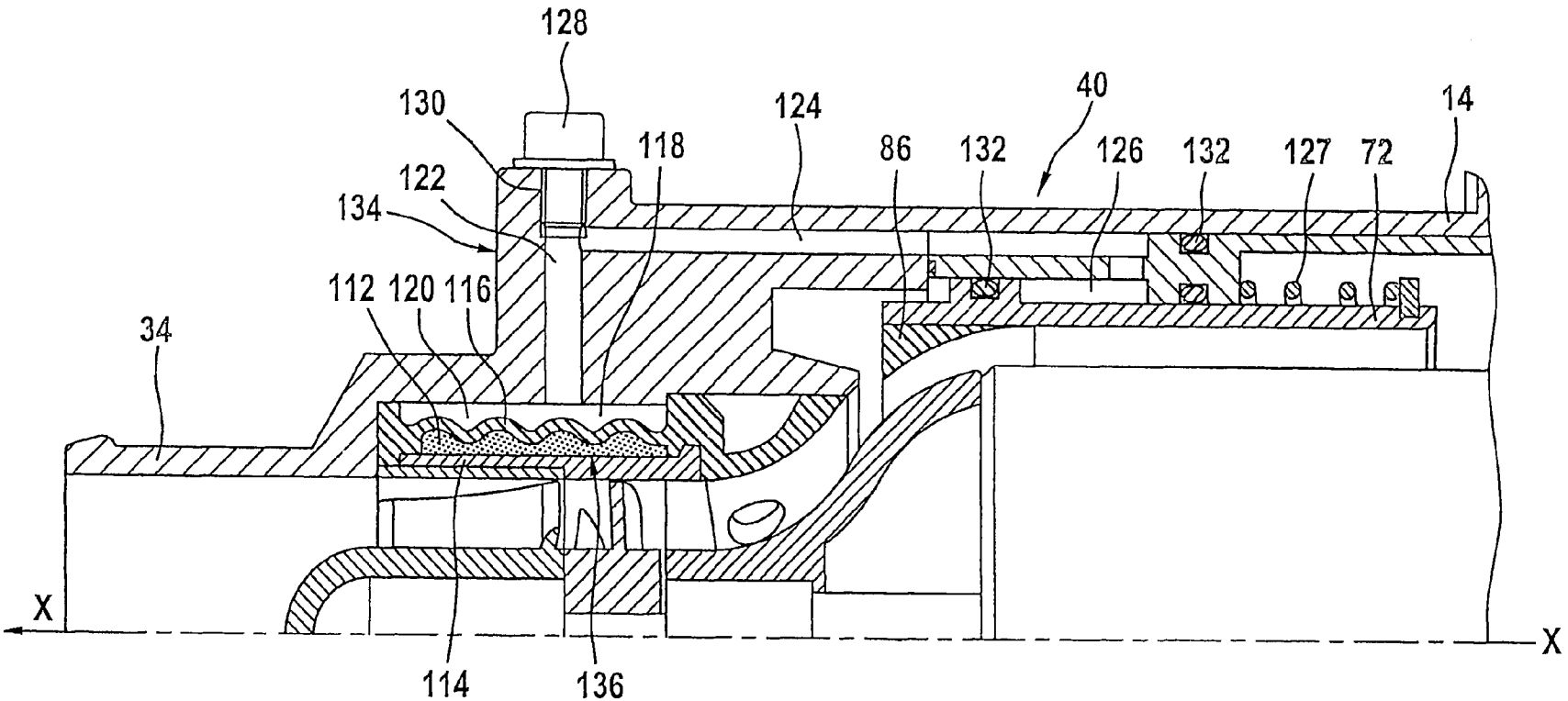
FIG. 10 shows an enlarged detail of the longitudinal sectional view along line A-A in FIG. 9.
Figure 11:
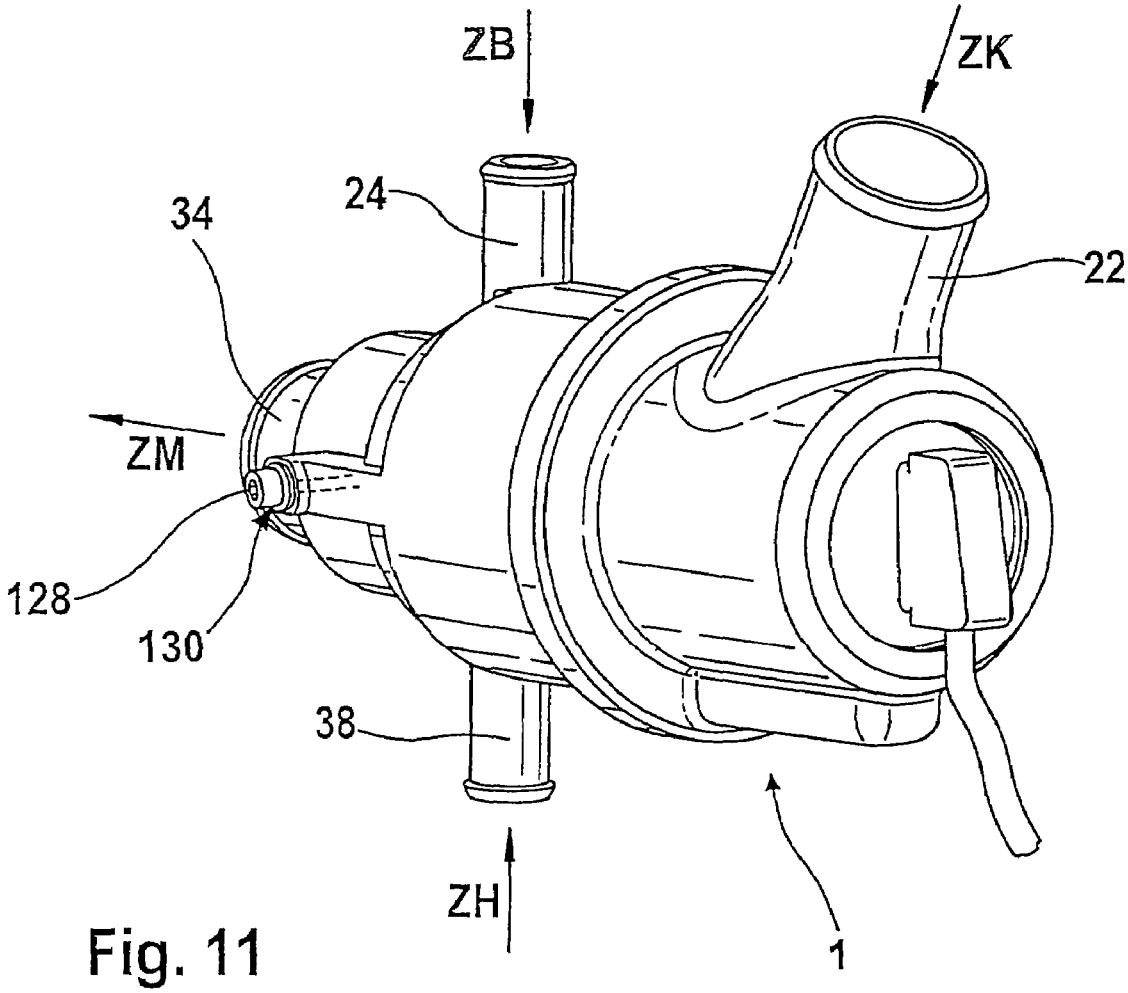
FIG. 11 is an external, three-dimensional view of this coolant variant.

In FIGS. 9 to 11 another variant of a coolant pump 1 is represented. In terms of its structure, the further variant of a coolant pump 1 shown in a longitudinal sectional view in FIG. 9 and in an enlarged detail in FIG. 10, and in a three-dimensional external view in FIG. 11, essentially corresponds to the coolant pump 1 discussed in FIGS. 1 to 6. Components that are identical or have a same effect are provided with the same reference numerals for purposes of easier representation.

The exemplary modifications shown in FIGS. 9 to 11 with a view to the more detailed representation of driving the directional control valve 40 by means of a thermally expandable element 112 may also correspondingly be transposed to the coolant pump variants shown in FIG. 1 to 6 and to those in FIGS. 7 and 8.

The alternative of driving the directional control valve 40 by means of a thermally expandable element 112 as shown in FIGS. 9 to 11 employs the volume change of the thermally expandable element 112 in accordance with the temperature prevailing in the pressure pipe 34 of the coolant mixture flowing through it. As a thermally expandable element 112 wax is used, for instance, in the variant represented here. The wax used here has a fusion point at approximately 85° C. The wax has the form of a wax member 112 that is solidified in the cold condition. The wax member 112 is arranged in spatial proximity or adjacent the pump outlet or the pressure pipe 34. As a result of the metallic inner jacket 114 provided as a delimitation against the passing coolant, it is directly exposed to any temperature changes in the coolant ZM flowing off towards the engine. Temperature influences from outside are suppressed by the insulation effect of the pump housing 14 that is comprised of plastics. When the thermally expandable element 112 formed of wax is heated or cooled, the volume change resulting in the process is transferred via a diaphragm 116 to a medium or coolant 120 stored in a reservoir 118. The coolant 120 may, e.g., be a water/glycol mixture.

Via connecting bores 122 and 124 the resulting differential volume arrives in a cylinder chamber 126 of the valve spool 72 of the directional control valve 40. Hereby a hydraulic stroke transmission is implemented. The coolant 120 flowing from the reservoir 118 to the cylinder chamber 126 upon an expansion of the wax 112 due to bulging of the diaphragm 116—or coolant 120 correspondingly flowing from the cylinder chamber 126 back to the reservoir 118 in the case of cooling of the wax 112—brings about a displacement of the valve spool 72 of the directional control valve 40 in a direction parallel with the longitudinal axis X of the coolant pump 1.

The coil spring 73 shown in the embodiments in accordance with FIGS. 1 to 8, which is there provided in order to ensure a fail-safe position of the directional control valve 40, is in the presently represented variant of the directional control valve not utilized any more for generating a fail-safe position but for achieving a closing function. As is shown in FIGS. 9 and 10, in the relaxed condition of the spring 127 the valve spool 72 assumes a position of "bypass open" or "radiator supply closed". Heating of the thermally expandable element 112 made of wax and the resulting volume expansion of the wax correspondingly brings about a bulge of the diaphragm 116 and thus a change of volume reservoir 118, ultimately resulting in a displacement of coolant 120 from the reservoir 118 into the cylinder chamber 126. This displacement of coolant 120 into the cylinder chamber 126 engenders a force acting against the spring force of the spring 127 and thus displacing the valve spool 72 into a position of "bypass closed" or "radiator feed open." The spring 127 correspondingly performs the required return stroke of the valve spool 72 upon cooling of the thermally expandable element 112. Inasmuch as this is a closed system, this process may be repeated an arbitrary number of times.

In comparison with an electromagnetic drive mechanism, driving of the directional control valve 40 through the intermediary of a thermally expandable element 112 has the additional advantage that a considerable weight may be saved. Namely, driving the directional control valve 40 by means of a solenoid 76, as illustrated in FIGS. 1 to 8, amounts to additional weight due to the solenoid 76. Here the advantages in terms of weight and partly also certain advantages in terms of costs lightweight of the thermally expandable element 112 make themselves felt in co-operation with the valve spool 72 that is designed for a hydraulic drive mechanism.

In addition it is possible to associate cooling and/or heating elements (not shown) to the thermally expandable element 112. Thus it is possible, optionally by utilizing the existing control means or CPU 100, corresponding temperature sensors, and possibly control circuits or the like, to actively influence the volume increase of the thermally expandable element 112 in order to adjust, where necessary, other control states of the directional control valve 40 than those that would result inherently.

The coolant 120 may be filled into the reservoir 118 or into the system through a filling opening 130 that is closed by a plug screw 128. The thermally expandable element 112 executed in wax has in the cold condition a sufficient dimensional stability for joint installation as a pre-fabricated component during assembly of the pump 1. Seal rings 132 or the like serve for sealing the valve spool 72 against the housing 14.

In FIG. 10 it is particularly well visible how the spring 127 forms a pair of forces across the transfer medium 120 including the thermally expandable element 112 and generates a permanent counterforce for the thermally expandable element 112. It is possible to use commercially available, thermally expandable wax for the thermally expandable element 112. The transfer medium, or coolant 120, may be a water/glycol mixture. The hydraulic system 134 constituted by reservoir 118 filled with coolant 120, connection lines 122 and 124, and cylinder chamber 126, is filled to a pressurized condition free of bubbles during assembly of the coolant pump 1. The thermally expandable element 112 formed of wax is inserted into the housing 14 during assembly of the pump 1, namely, in the interstice 136 between the metallic cylinder jacket 114 limiting the radial play of the impeller 32 and the inner wall of the elastomer diaphragm 116, and thus is hermetically delimited. The wax has a fusion point of approx. 85° C. It is fundamentally possible to influence the wax 112 by means of a heating and/or a cooling element.

The variant of the coolant pump 1 represented in a longitudinal sectional view in FIG. 9 and in an enlarged, partially cut-open view in FIG. 10 is visualized in FIG. 11 in a three-dimensional view for better comprehension of the spatial association of the components.

The constructive design of the wax member is harmonized with the structural conditions of the coolant pump. The directional control valve, ultimately actuated hydraulically by means of the thermally expandable element, advantageously has a similar effect as an electrically controllable thermostat. The components of a vehicle influencing consumption and emissions are presently in the focus of interest. A characteristic-diagram control thermostat is a component that positively influences the fuel consumption and the reduction of emissions. Conventional thermostats are set to a fixed opening temperature that can not be changed. With the aid of an electrically controlled characteristic diagram thermostat, the opening temperature of a valve may be varied in accordance with various parameters, e.g., load, speed, advance angle, exterior temperature, engine oil temperature, running velocity, etc. These advantages are also obtained with the directional control valve of the coolant pump of the invention that is actuated electromagnetically or hydraulically with the aid of a thermally expandable element.

The wax member may optionally be heated or cooled in addition. For heating it is possible to employ a rod heating (not shown). The latter performs heating of the wax member while in direct contact with the wax. Heating of the rod heating may take place, e.g., with the aid of a resistance wire wound on a ceramic body. In the absence of heating, the thermostat thus formed may be set, e.g., to a temperature of 110° C. By heating the temperature may be lowered, e.g., to approx. 70 C. The full opening temperature is thus reached at respective 15° C. above the normal opening temperature. The response time of the thermostat may be influenced through heating power, depth of insertion of the rod heating into the wax member, and the surface characteristics of the wax member.

In order to be able to test the above mentioned application in the development phase, a electronic system was developed by the applicant which allows to process any input quantities utilized in engine management. By means of corresponding links the required outputs are subsequently driven, for instance via corresponding control circuits, the control means or CPU 100, etc. Depending on the internal combustion engine, the links are freely programmable. In large-series use the program may then be stored, e.g., in the electronic system for the respective internal combustion engine. A separate electronic system is not required in this case.

The present invention for the first time specifies a coolant pump for a coolant circuit of an automotive internal combustion engine, comprising at least a radiator circuit and a bypass circuit. The coolant pump housing comprises an intake pipe, a bypass pipe and a pressure pipe, as well as a coolant pump electric motor arranged in the coolant pump housing, the motor housing of which is placed in a flow of coolant, and which drives a pump impeller via a pump shaft, as well as a directional control valve integrated into the coolant pump housing. The intake pipe is for the first time arranged in the area of the end of the pump motor facing away from the pump impeller. The bypass pipe is moreover arranged in an area situated downstream of the intake pipe. The pressure pipe is arranged in an area situated downstream of the bypass pipe. Solely the coolant that may be taken in through the intake pipe supply from the radiator is to be adapted to be taken past the pump motor in a peripheral flow through a flow channel defined by the outer wall of the pump motor housing and the facing inner wall of the pump housing and/or the facing inner wall of the directional control valve.

LIST OF REFERENCE NUMERALS

1 Coolant pump
2 coolant circuit
4 radiator circuit
6 radiator
8 bypass circuit
10 engine
12 heating circuit
13 heating
14 pump housing
16 first housing part
18 second housing part
20 clasp, clamp or bracket
22 intake pipe
24 bypass pipe
26 coolant pump electric motor
28 motor housing
30 pump shaft
32 pump impeller
34 pressure pipe
36 runner
38 heating return flow
40 directional control valve
42 area, upstream
44 upstream end of the pump motor
46 area, downstream of the intake pipe
48 area, downstream of bypass pipe
50 peripheral flow
52 outer wall of the pump motor
54 inner wall of the pump housing
56 flow channel
60 inner wall of the directional control valve
62 bypass outlet
64 downstream end of the flow channel
66 cross-section of the flow channel
68 downstream end of the pump motor housing
70 inner diameter of the pressure pipe
72 directional control valve executed as a valve spool
73 coil spring
74 valve spool concurrently formed as an armature of the operating solenoid
76 operating solenoid
78 coil carrier of the operating solenoid
80 coil of the operating solenoid
82 yoke, radially outside the coil, encompassing the latter
84 yoke with influence on characteristic, between coil and armature
86 seal of elastomer
88 end face
90 seal seat, in the pump housing
92 radially outwardly directed seal tip
94 pump shaft housing
96 coil terminals, oriented axially, or in parallel with X axis
100 control means or CPU
102 amplifier unit
104 connector
106 drive wheel
108 free-wheel
110 shaft bearing
112 thermally expandable element executed in wax
114 metallic inner jacket
116 diaphragm
118 reservoir
120 coolant
122 connecting bore
124 connecting bore
126 cylinder chamber
127 spring
128 plug screw
130 filling opening
132 seal rings
134 hydraulic system
136 interstice

The invention claimed is:

1. A coolant pump (1) for a coolant circuit (2) of an automotive internal combustion engine (10) including at least a radiator circuit (4) and a bypass circuit (8), which comprises: a coolant pump housing (14) having an intake pipe (22) for the supply (ZK) from the radiator (6), a bypass pipe (24) for the supply (ZB) from the bypass circuit (8), and a pressure pipe (34) for the supply (ZM) of coolant to the automotive vehicle engine (10), a coolant pump electric motor (26) arranged in the coolant pump housing (14), the motor housing (28) of which is situated in the coolant flow, and which drives a pump impeller (32) through the intermediary of a pump shaft (30), and a directional control valve (40) integrated into the coolant pump housing (14), characterized in that the intake pipe (22) is arranged in the area (42) of the end (44) of the pump motor (26) facing away from the pump impeller (32), the bypass pipe (24) is arranged in an area (46) situated downstream of the intake pipe (22), the pressure pipe (34) is arranged in an area (48) situated downstream of the bypass pipe (24), and only the coolant (KZK) that can be taken in by the intake pipe (22) as a supply (ZK) from the radiator (6) may be taken past the pump motor (26) in a peripheral flow (50) through a flow channel (56) defined by an outer wall (52) of the pump motor housing (28) and a facing inner wall (54) of the pump housing (14) and a facing inner wall (60) of the directional control valve (40).

2. The coolant pump (1) in accordance with claim 1, characterized in that the coolant (KZB) of the bypass circuit (8) that may be taken in through the bypass pipe (24) may be admixed to the coolant (KZK) arriving from the radiator circuit (4) with the aid of the directional control valve (40), wherein an outlet (62) of the bypass pipe (24) adapted to be opened and closed again with the aid of the directional control valve (40) is disposed in an area (42) upstream of the pump impeller (32).

3. The coolant pump (1) in accordance with claim 2, characterized in that an outlet (62) of the directional control valve (40) is disposed in an area (42) between the pump impeller (32) and a downstream end (64) of a flow channel (56).

4. The coolant pump (1) in accordance with claim 1, characterized in that the pump motor (26) and the pump shaft (30) are arranged coaxially with a longitudinal axis X of the pump housing (14).

5. The coolant pump (1) in accordance with claim 1, characterized in that the flow channel (56) defined by the outer wall (52) of the motor housing (28) enclosing the pump motor (26) and the facing inner wall (54) of the pump housing (14) and the facing inner wall (60) of the directional control valve (40) has an annular cross-section through which the coolant (KZK) that can be taken in through the intake pipe (22) for the supply (ZK) from the radiator (6) may be taken past the pump motor (26) in a peripheral flow (56) annularly enclosing the motor housing (28).

6. The coolant pump (1) in accordance with claim 1, characterized in that a flow channel (56) has a cross-section (66) that is constant in the direction of flow, wherein a constriction from the diameter present at the end of the flow channel (56) to an inner diameter (70) of the pressure pipe (34) takes place from a downstream end (68) of the pump motor (26) to the pump impeller (32).

7. The coolant pump (1) in accordance with claim 1, characterized in that the directional control valve (40) may be switched continuously from a closed position of "bypass closed" into an open position of "bypass open."

8. The coolant pump (1) in accordance with claim 1, characterized in that the directional control valve (40) has the form of a valve spool (72) slidingly displaceable in a longitudinal direction X of the coolant pump (1).

9. The coolant pump (1) in accordance with claim 8, characterized in that the valve spool has the form of a cylindrical sleeve (72).

10. The coolant pump (1) in accordance with claim 8, characterized in that the valve spool (72) may be displaced by an actuator comprising any one of at least an operating solenoid (76), a thermally expandable element (112), and a hydrostatic pressure member.

11. The coolant pump (1) in accordance with claim 8, characterized in that the valve spool (72) has downstream in an area of outlet (62) a radially inner, annular peripheral seal (86), which in the closed postion, "bypass closed", of the directional control valve (40) sealingly closes the outlet (62) thereof by means of an end face (88) against an annular seal seat (90) of the pump housing (14), and in the open condition, "bypass open", sealingly closes the flow channel (56) by means of a radially inwardly directed seal lip (92) against the pump motor housing (28) or a pump shaft housing (94).

12. The coolant pump (1) in accordance with claim 11, characterized in that a radially inwardly directed surface of the seal (86) has a contour corresponding to an opposite contour of the motor housing (28) or of the pump shaft housing (94).

13. The coolant pump (1) in accordance with claim 8, characterized in that an operating solenoid (76) of the valve spool (72) includes an armature (74) formed by a cylindrical sleeve of the valve spool (72).

14. The coolant pump (1) in accordance with claim 13, characterized in that the operating solenoid (76) includes a coil carrier (78) arranged in the pump housing (14) and enclosing the armature (74).

15. The coolant pump (1) in accordance with claim 8, characterized in that the valve spool (72) has downstream in an area of an outlet (62) a radially inner, annular peripheral seal (86), which in the closed postion, "bypass closed", of the directional control valve (40) sealingly closes the outlet (62) thereof by means of an end face (88) against an annular seal seat (90) of the pump housing (14), or in the open condition, "bypass open", sealingly closes the flow channel (56) by means of a radially inwardly directed seal lip (92) against the pump motor housing (28) or a pump shaft housing (94).

16. The coolant pump (1) in accordance with claim 1, characterized in that downstream following the bypass pipe (24) and still upstream of the pump impeller (32), a return flow (38), for at least any one of a heating circuit, a transmission oil heat exchanger, a lubricant oil heat exchanger, and a cylinder block cooling circuit, merges into the pump housing (14).

17. The coolant pump (1) in accordance with claim 1, characterized in that the pump housing (14) is constructed in two parts (16, 18).

18. The coolant pump (1) in accordance with claim 1, characterized in that an operating solenoid (76) has coil terminals (96) oriented in a longitudinal direction X, which may by means of correlating terminals (98) be taken into contact with control means (100) accommodated in the other housing part (18) upon joining together the two housing parts (16, 18).

19. The coolant pump (1) in accordance with claim 18, wherein the control means (100) is a CPU.

20. The coolant pump (1) in accordance with claim 1, characterized in that in addition to driving the pump impeller (32) by the coolant pump electric motor (26), a drive wheel (106) is provided which is arranged coaxially with the pump shaft (30) externally of the pump housing (14) and coupled to the pump shaft (30) via a free-wheel (108).

21. The coolant pump (1) in accordance with claim 1, characterized in that a thermally expandable element (112) is in operative connection with the directional control valve (40) via connection lines (122, 124) such that the directional control valve (40) may be switched hydraulically through a volume change of the thermally expandable element (112).

22. The coolant pump (1) in accordance with claim 1, characterized in that a thermally expandable element (112) is formed of wax, the temperature-dependent volume change of which may be transferred to a hydraulically actuatable valve spool (72) via a separate coolant (120) and connection lines (122, 124).

23. The coolant pump (1) in accordance with claim 1, characterized in that a thermally expandable element (112) formed of wax is arranged in an area adjacent the pressure pipe (34) in the pump housing (14) and is separated from an associated, separate coolant (120) through a diaphragm (116), such that a temperature-dependent volume change of the thermally expandable element (112) may be transferred to the coolant (120), which in turn may be displaced via connection lines (122, 124) into a cylinder chamber (126) of a valve spool (72) thus adapted to be actuated hydraulically.

24. The coolant pump (1) in accordance with claim 1, characterized in that the flow channel (56) defined by the outer wall (52) of the motor housing (28) enclosing the pump motor (26) and the facing inner wall (54) of the pump housing (14) or the facing inner wall (60) of the directional control valve (40) has an annular cross-section through which the coolant (KZK) that can be taken in through the intake pipe (22) for the supply (ZK) from the radiator (6) may be taken past the pump motor (26) in a peripheral flow (56) annularly enclosing the motor housing (28).

25. A method for conveying coolant by means of a coolant pump (1) for a coolant circuit (2) of an automotive internal combustion engine (10) comprising at least a radiator circuit (4) and a bypass circuit (8), comprising the steps: supplying the coolant from the radiator (6) to the coolant pump (1) through an intake pipe (22) of the coolant pump housing (14) for the supply (ZK), supplying the coolant from the bypass circuit (8) to the coolant pump (1) of the coolant pump housing (14) through a bypass pipe (24) for the supply (ZB), returning the coolant from the coolant pump (1) to the automotive vehicle engine (10) through a pressure pipe (34) for the coolant return (ZM), circulating the coolant (1) by means of a pump impeller (32) arranged in the coolant pump housing (14) and driven by a coolant pump electric motor (26) via a pump shaft (30), wherein the engine (26) is situated in a flow of the coolant, adjusting the mixing ratio of the coolant flows circulating through the coolant pump by means of a directional control valve (40) integrated into the coolant pump housing (14), characterized in that the coolant arriving from the radiator (6) is supplied via the intake pipe (22) in the area (42) of the end (44) of the pump motor (26) facing away from the pump impeller (32), the coolant arriving from the bypass is supplied via the bypass pipe (24) in an area (42) located downstream of the intake pipe (22), the coolant is taken away via the pressure pipe (34) in an area (42) located downstream of the bypass pipe (24), and only the coolant (KZK) supplied from the radiator (6) through the intake pipe (22) as a supply (ZK) is taken in a peripheral flow (50) past the pump motor (26) through a flow channel (56) defined by an outer wall (52) of the pump motor housing (28) and a facing inner wall (54) of the pump housing (14) and a facing inner wall (60) of the directional control valve (40).

26. A coolant pump (1) for a coolant circuit (2) of an automotive internal combustion engine (10) including at least a radiator circuit (4) and a bypass circuit (8), which comprises: a coolant pump housing (14) having an intake pipe (22) for the supply (ZK) from the radiator (6), a bypass pipe (24) for the supply (ZB) from the bypass circuit (8), and a pressure pipe (34) for the supply (ZM) of coolant to the automotive vehicle engine (10), a coolant pump electric motor (26) arranged in the coolant pump housing (14), the motor housing (28) of which is situated in the coolant flow, and which drives a pump impeller (32) through the intermediary of a pump shaft (30), and a directional control valve (40) integrated into the coolant pump housing (14), characterized in that the intake pipe (22) is arranged in the area (42) of the end (44) of the pump motor (26) facing away from the pump impeller (32), the bypass pipe (24) is arranged in an area (42) situated downstream of the intake pipe (22), the pressure pipe (34) is arranged in an area (42) situated downstream of the bypass pipe (24), and only the coolant (KZK) that can be taken in by the intake pipe (22) as a supply (ZK) from the radiator (6) may be taken past the pump motor (26) in a peripheral flow (50) through a flow channel (56) defined by an outer wall (52) of the pump motor housing (28) and a facing inner wall (54) of the pump housing (14) or a facing inner wall (60) of the directional control valve (40).

27. A method for conveying coolant by means of a coolant pump (1) for a coolant circuit (2) of an automotive internal combustion engine (10) comprising at least a radiator circuit (4) and a bypass circuit (8), comprising the steps: supplying the coolant from the radiator (6) to the coolant pump (1) through an intake pipe (22) of the coolant pump housing (14) for the supply (ZK), supplying the coolant from the bypass circuit (8) to the coolant pump (1) of the coolant pump housing (14) through a bypass pipe (24) for the supply (ZB), returning the coolant from the coolant pump (1) to the automotive vehicle engine (10) through a pressure pipe (34) for the coolant return (ZM), circulating the coolant (1) by means of a pump impeller (32) arranged in the coolant pump housing (14) and driven by a coolant pump electric motor (26) via a pump shaft (30), wherein the engine (26) is situated in a flow of the coolant, adjusting the mixing ratio of the coolant flows circulating through the coolant pump by means of a directional control valve (40) integrated into the coolant pump housing (14), characterized in that the coolant arriving from the radiator (6) is supplied via the intake pipe (22) in the area (42) of the end (44) of the pump motor (26) facing away from the pump impeller (32), the coolant arriving from the bypass is supplied via the bypass pipe (24) in an area (42) located downstream of the intake pipe (22), the coolant is taken away via the pressure pipe (34) in an area (42) located downstream of the bypass pipe (24), and only the coolant (KZK) supplied from the radiator (6) through the intake pipe (22) as a supply (ZK) is taken in a peripheral flow (50) past the pump motor (26) through a flow channel (56) defined by an outer wall (52) of the pump motor housing (28) and a facing inner wall (54) of the pump housing (14) or a facing inner wall (60) of the directional control valve (40).

* * * * *